US006531990B2

(12) United States Patent
Verkerk

(10) Patent No.: US 6,531,990 B2
(45) Date of Patent: Mar. 11, 2003

(54) GIMBAL SYSTEM FOR SATELLITE ANTENNA

(75) Inventor: Neil Verkerk, Santa Clarita, CA (US)

(73) Assignee: Datron Advanced Technologies, Inc., Simi Valley, CA (US)

( * ) Notice: Subject to any disclaimer, the term of this patent is extended or adjusted under 35 U.S.C. 154(b) by 0 days.

(21) Appl. No.: 09/879,762

(22) Filed: Jun. 12, 2001

(65) Prior Publication Data

US 2002/0030631 A1 Mar. 14, 2002

Related U.S. Application Data

(60) Provisional application No. 60/210,792, filed on Jun. 12, 2000.

(51) Int. Cl.[7] ..... H01Q 3/02; H01Q 3/00

(52) U.S. Cl. ..... 343/882; 343/878; 343/765; 343/766

(58) Field of Search ..... 343/878, 880, 343/882, 757, 765, 766, 761

(56) References Cited

U.S. PATENT DOCUMENTS

| | | | | |
|---|---|---|---|---|
| 4,204,214 A | | 5/1980 | Fassnacht | 343/766 |
| 4,868,578 A | | 9/1989 | Bruinsma et al. | 343/882 |
| 4,920,350 A | | 4/1990 | McGuire et al. | 343/709 |
| 4,937,587 A | * | 6/1990 | Tsuda | 343/765 |
| 5,517,204 A | | 5/1996 | Murakoshi et al. | 343/765 |
| 5,517,205 A | | 5/1996 | Van Heyningen | 343/765 |
| 5,999,139 A | | 12/1999 | Benjamin et al. | 343/765 |
| 6,002,376 A | * | 12/1999 | Chiba | 343/878 |
| 6,285,338 B1 | * | 9/2001 | Bai et al. | 343/882 |
| 6,285,339 B1 | * | 9/2001 | McGill | 343/882 |

* cited by examiner

*Primary Examiner*—Don Wong
*Assistant Examiner*—Hoang Nguyen
(74) *Attorney, Agent, or Firm*—Edward A. Sokolski

(57) ABSTRACT

A gimbal system is used for supporting and enabling the orientation of a circular satellite antenna dish in azimuth and elevation. The gimbal system includes a hoop structure, the ends of which are connected to the antenna dish. The dish is pivotally supported on the hoop structure for pivotal motion about its "X" axis. The hoop structure is mounted for rotation about the "Y" axis of the dish. The central axis of the hoop is coincidental with the central axis of the antenna. The hoop is driven by means of a motor to rotate the hoop and the antenna dish along therewith between a first position whereat the "Y" axis of the antenna is in its normal initial at rest (Y axis zero position) and a second position wherein the "Y" axis is rotated approximately eighty degrees from this initial position. A second motor is coupled to the antenna at one of the ends of the hoop structure to drive the dish about its "X" axis.

14 Claims, 6 Drawing Sheets

GIMBAL SYSTEM FOR SATELLITE ANTENNA

This application is based on provisional application No. 60/210,792 filed Jun. 12, 2000.

BACKGROUND OF THE INVENTION

1. Field of the Invention.

This invention relates to a gimbal system for supporting and orienting an antenna and more particularly to such a system for communicating with a satellite that provides a maximum aperture along with minimum swept volume.

2. Description of the Related Art.

Prior art gimbal systems for antennas used in installations for communications with satellites typically utilize configurations in which the elevation gimbal is mounted on the azimuth gimbal, or have gimbal architecture with non-intersecting X-Y axes. The first of these configurations has the disadvantage of a Keyhole(blind spot) directly overhead( at 90 degrees) and larger swept volume. The second configuration type requires axis counterweighing which also increases size and weight. Many prior art gimbal systems are overweight and over costly for mass production. Prior art systems along the lines indicated above are described in U.S. Pat. No. 5,999,139 issued Dec. 7, 1999 to Benjamin et Al., U.S. Pat. No. 5,517,204 issued May 14, 1996 to Murakoshi et al., and U.S. Pat. No. 4,920,350 issued Apr. 24, 1990 to McGuire et al.

SUMMARY OF THE INVENTION

The device of the present invention is an improvement over the prior art in that it provides a simpler, less bulky, lighter weight and less costly antenna gimbal system which does not have an overhead blind spot and is particularly suitable for use in smaller portable installations.

This improved end result is achieved by utilizing a hoop structure, the ends of which are connected to the antenna in a manner permitting pivotal motion of the antenna relative to the hoop structure but not axial motion. The hoop structure and the antenna have a common central axis. The antenna is pivotally supported for rotatable motion on the hoop structure. The hoop structure is motor driven in a manner to drive the antenna so as to rotate the initial Y axis of the antenna to any desired Y axis position between zero and ninety degrees. A second motor is connected by means of a drive gear or pulley to the antenna at one of the ends of the hoop support structure to rotatably drive the antenna on its pivotal support(X axis). With the Y axis of the antenna in its initial "at rest zero" position, the second motor operates to drive the antenna in elevation to any position between zero and eighty degrees. With the Y axis of the antenna in its eighty degree position, the second motor operates to drive the antenna X axis in azimuth to simulate an azimuth positioning axis. The Y axis of the antenna can be positioned as desired at any angle between zero and eighty degrees simultaneously with the positioning of the X axis of the antenna to provide various combinations of azimuth and elevation orientation, providing full hemispherical coverage down to the horizon.

The present invention thus provides a simple structure for obtaining orientations at desired azimuths and elevations with a single drive for obtaining such orientations operating in conjunction with a motor driven hoop structure.

It is therefore an object of this invention to provide an improved gimbal structure with full azimuth and elevation orientation for an antenna which can be used to communicate with a satellite;

It is a further object of this invention to provide a gimbal system for a satellite antenna which is of less swept radius, bulk, weight and cost than that of prior art systems.

It is further object of this invention to provide an improved gimbal system for a satellite antenna using a single drive for both azimuth and elevation with which there is no blind spot at ninety degrees elevation and for which minimum counter weighting is required.

Other objects of the invention will become apparent in view of the following description taken in connection with the accompanying drawings.

DETAILED DESCRIPTION OF THE INVENTION

Figure 1:
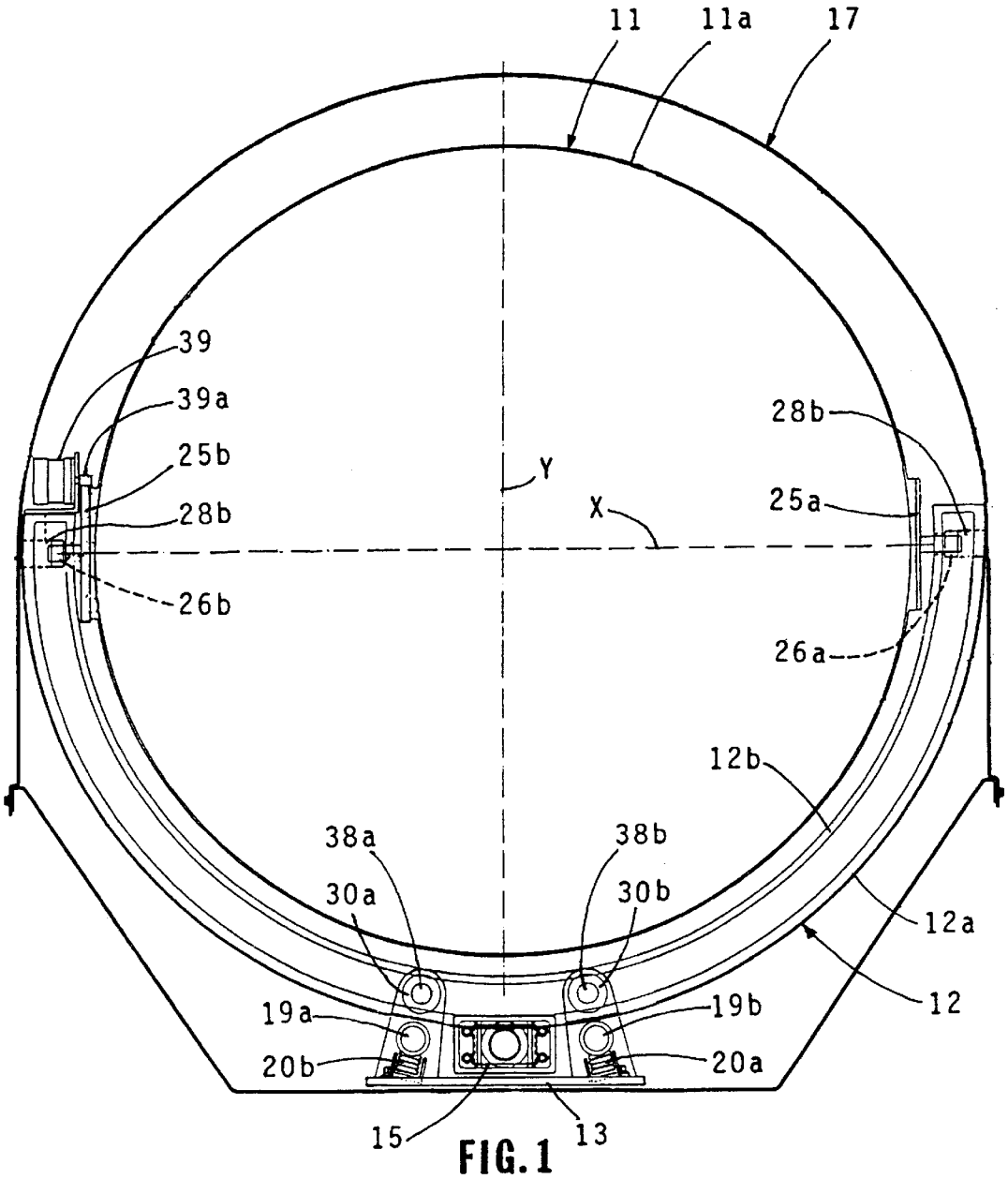
FIG. 1 is a front elevational view of a preferred embodiment of the invention.

Referring now to the FIGS, a preferred embodiment of the device of the invention is shown. Antenna assembly 11 which includes a parabolic reflector dish 11*a* is mounted on a base assembly 13 and under a protective housing 17. The dish has a pair of flanges 25*a* and 25*b* which are attached to the opposite sides thereof. Posts 26*a* and 26*b* extend from each of the flanges respectively and fit through apertures in the hoop wall. A retainer 28 is used to retain the posts to the hoop. The dish is thus supported for pivotal motion relative to the housing.

Hoop structure 12 has a pair of opposing spaced apart sections 12*a* and 12*b* which are joined together at their opposite ends. Posts 26*a* and 26*b* are fitted within apertures formed in the end portions of the hoop structure. The hoop is shown truncated to make for a half hoop. It is to be noted, however, that a full circular loop or a loop truncated between a half and full loop,could also be used provided the antenna is attached to the hoop in the manner shown for the preferred embodiment.

Figure 4:
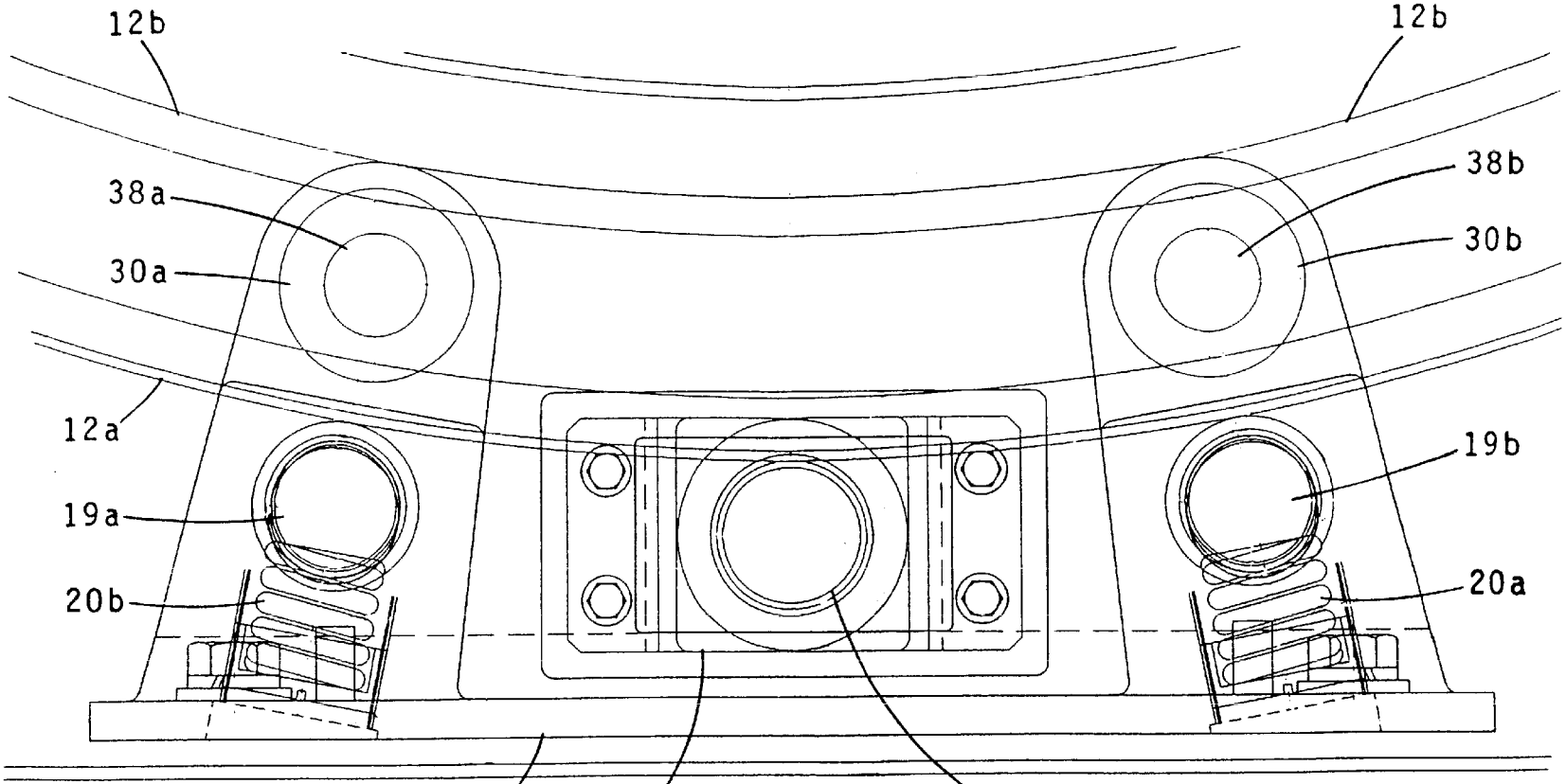
FIG. 4 is a front elevational view illustrating the drive mechanism for the hoop structure.

Referring now additionally to FIG. 4, the support and drive for the hoop structure is illustrated. It is to be noted that the hoop structure 12 has an arc and center axis which is the same as that of the dish. The hoop structure is maintained in position axially,by means of two sets of rollers. A lower roller set 19*a* and 19*b* are mounted in the housing of base 13. These rollers are urged by springs 33*a* and 33*b* respectively to apply force against the outer wall of hoop section 12*a*. This force is resisted by inner paired roller sets 30*a*, 38*a* and 30*b*, 38*b* which apply force to the inside surface of the outer hoop section 12*a*. The inner wall section 12*b* of the hoop acts as a stiffening wall of the hoop "H" section. Electric motor 15 has a geared shaft 15*a* which engages recessed gear teeth formed along the outer edge of hoop element 12*a*.

Figure 5:
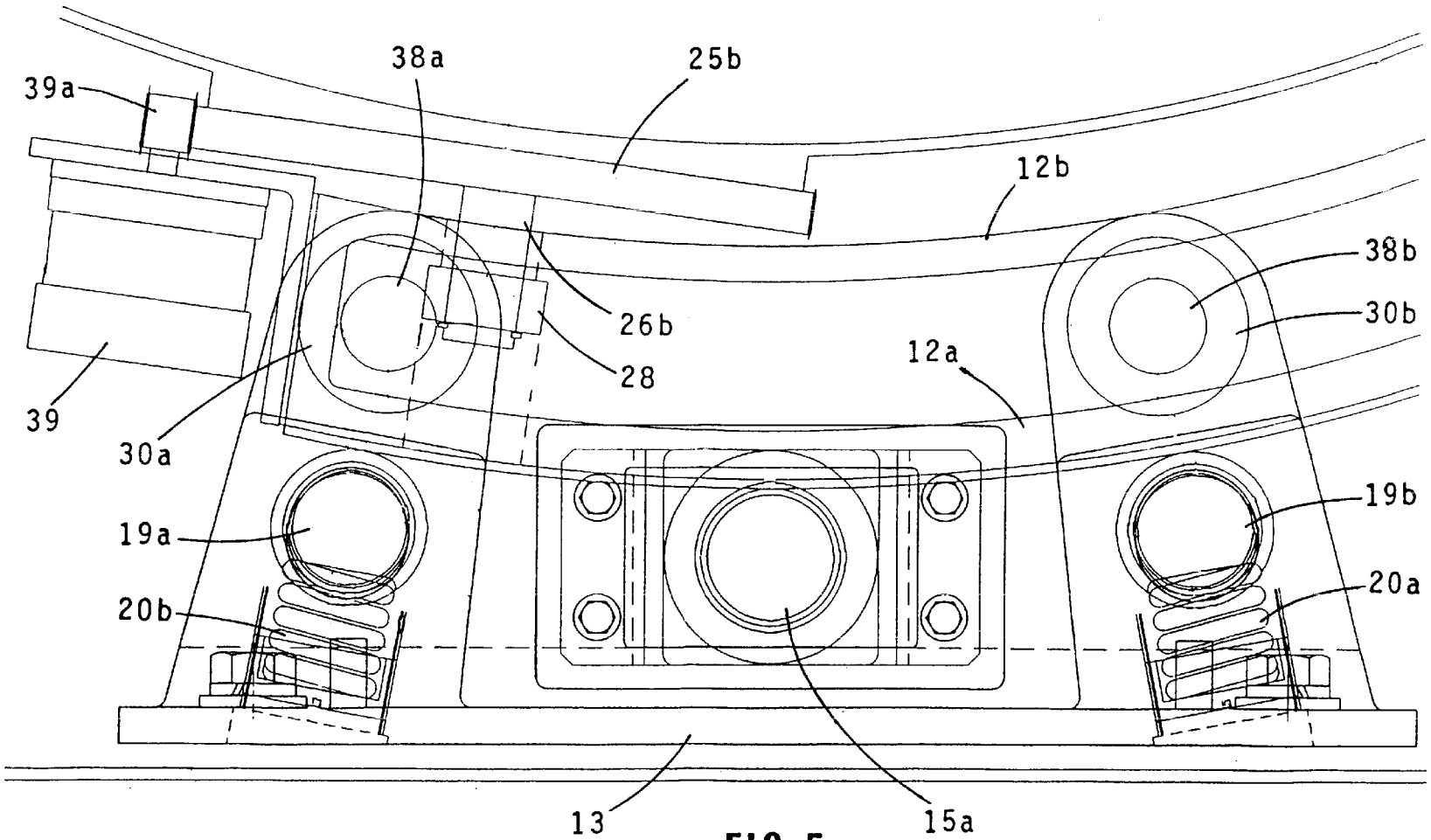
FIG. 5 is a front elevational view the drive system for the antenna drive.
Figure 6:
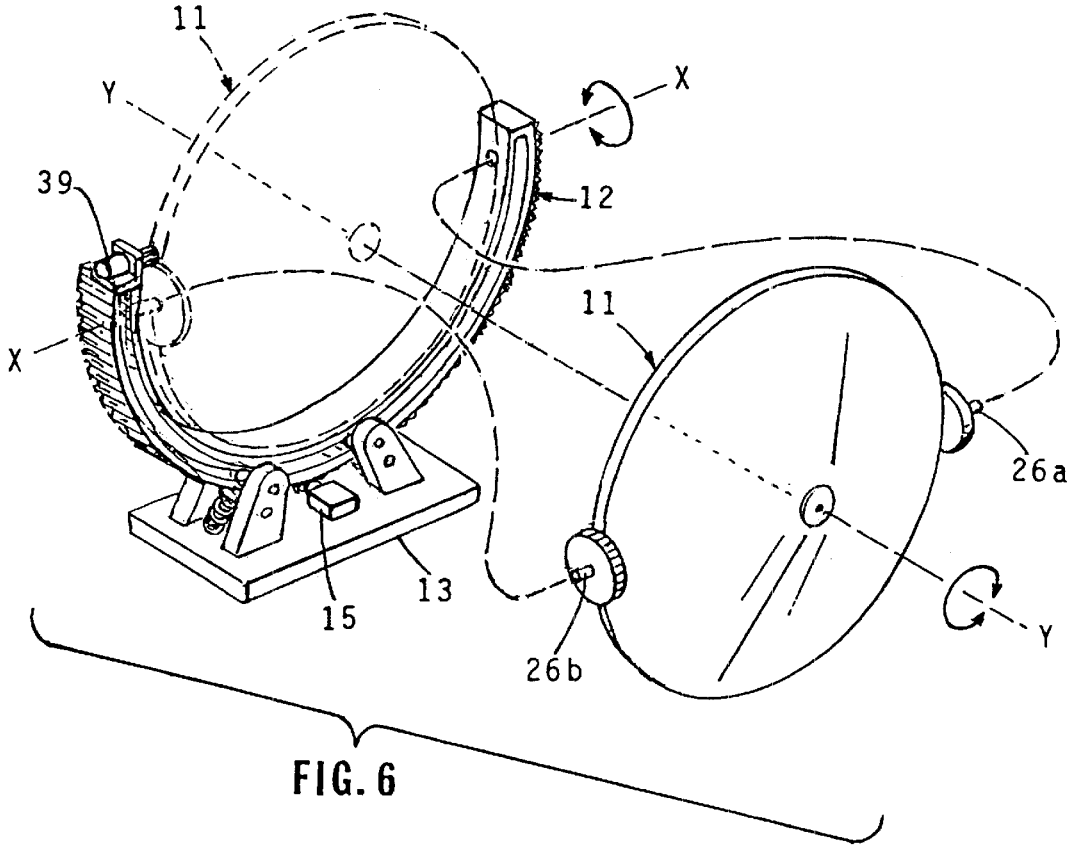
FIG. 6 is a front elevational view illustrating the antenna elevation and azimuth drive of the preferred embodiment.

Referring now additionally to FIG. 5, flanges 25*a* and 25*b* are attached to the dish 11*a* near the edge thereof in opposing positions 90 degrees from base assembly 13. Motor 39 has a geared shaft 39*a* which mates with the geared edge of flange 25*b* such that it can drive the dish in either azimuth, elevation or simultaneously in a combination of both azimuth and elevation, depending on the position of the hoop structure.

Figure 2:
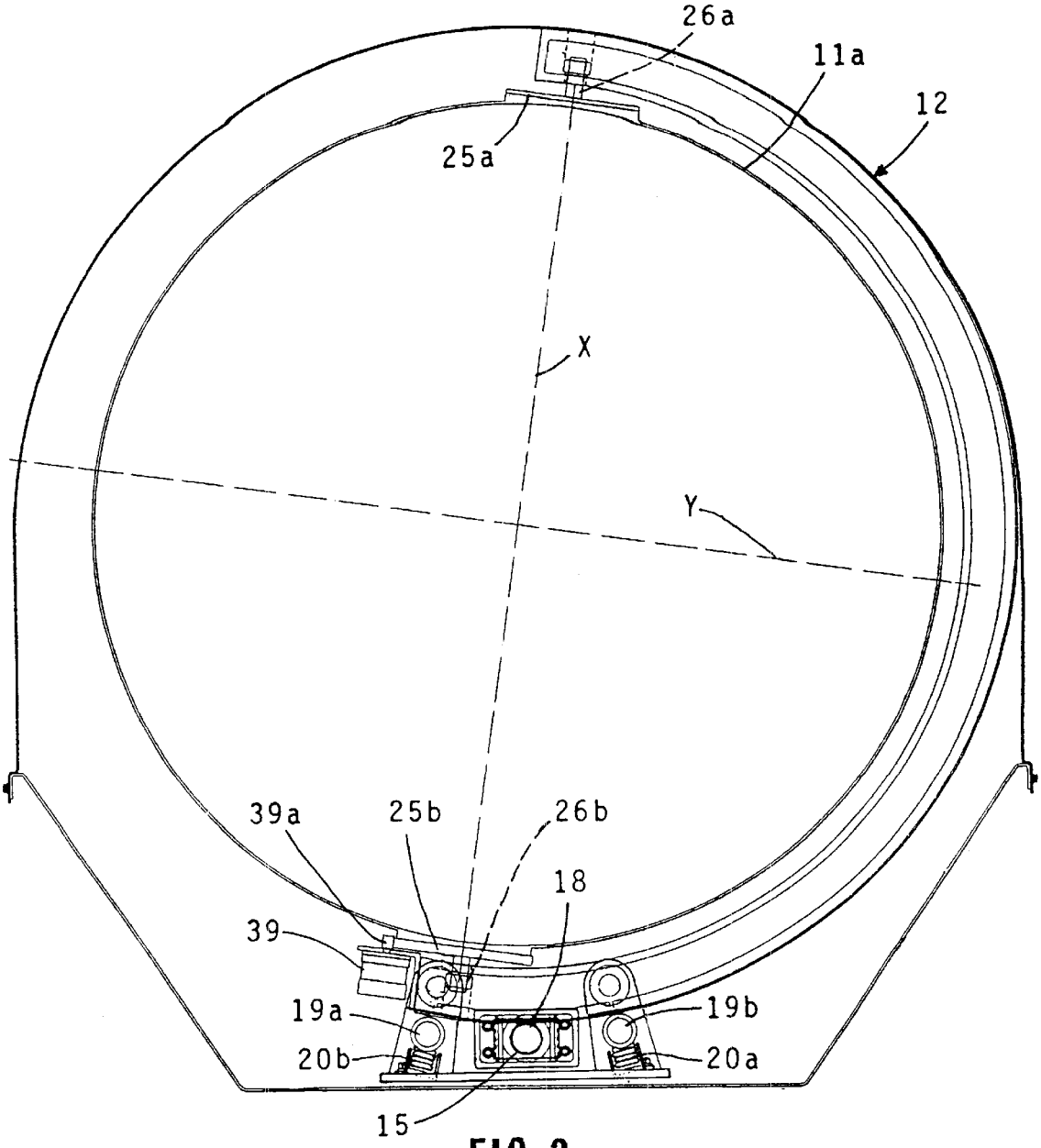
FIG. 2 is a front elevational view of the preferred embodiment with the Y axis of the antenna rotated.
Figure 3:
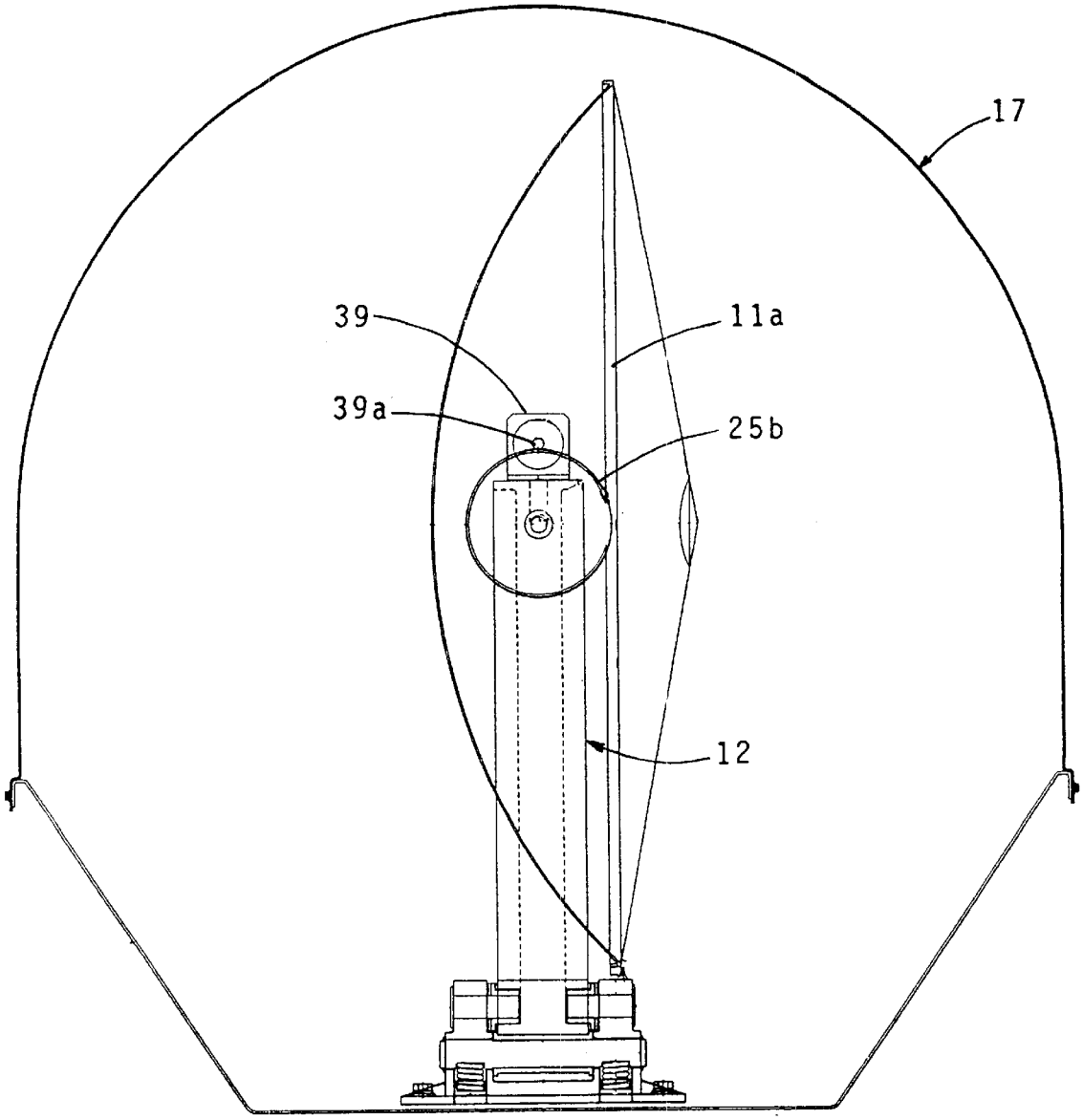
FIG. 3 is a side elevational view of the preferred embodiment.

The system of the invention operates in the following manner. As shown in FIG. 1, the system is in an initial at rest position with the Y axis of the antenna in its "zero" position. In this position, motor 39 can be actuated to drive the antenna in elevation to any position between zero and ninety degrees. To position the antenna strictly in azimuth, the hoop structure and the antenna along with it are driven until the Y axis has been rotated 80–90 degrees and motor 39 then actuated to drive the antenna dish to the desired azimuth position. For a combined azimuth-elevation movement, the hoop and along with it the antenna, are driven by means of motor 15 to bring the Y axis of the antenna to any desired position between zero and ninety degrees. As shown in FIG. 2, for illustrative purposes, the Y axis has been rotated to one side of its plus or minus eighty degree position from center. In this position, the Antenna X-axis can be driven to provide a scan which is mainly in azimuth but which also includes a slight elevation scan. As the Y-axis is repositioned closer to its zero or centered position, the antenna X-axis can be driven gradually to change from a dominant azimuth scan to a dominant (and finally pure) elevation scan. In this manner, the motion of the antenna dish can be set to move directly to the target along a path combining both azimuth and elevation.

While the invention has been described and illustrated in detail, it is to be understood that this is intended by way of illustration and example only, the scope of the invention being limited by the terms of the following claims.

I claim:

1. A gimbal structure for supporting an antenna having a circular dish and driving said antenna in azimuth and elevation comprising:

a hoop structure having a curvature and central axis which is substantially the same as that of the circular antenna dish, means for pivotally supporting said dish on said hoop structure at opposing points on both said dish and said hoop structure, means for driving said hoop structure and said antenna dish along with said hoop structure about said central axis between a first position whereat the Y axis of the antenna dish is in a predetermined "zero" position and a second position whereat the Y axis of the antenna dish is in a position between zero and ninety degrees degrees from said "zero" position, and means for pivotally driving said dish, whereby when said dish is in said first position said antenna dish is pivotally driven in elevation and when said dish is in said second position, said antenna is driven in azimuth or a combination of azimuth and elevation.

2. The gimbal structure of claim 1 wherein said hoop structure is semi-circular.

3. The gimbal structure of claim 1 wherein said hoop structure is formed in: two opposing wall sections with a space section therebetween.

4. The gimbal structure of claim 1 wherein said means for driving said hoop structure comprises an electric motor having drive shaft with a geared surface, said hoop structure having a geared surface which engages the geared surface of said drive shaft.

5. The gimbal structure of claim 1 wherein said means for driving said antenna dish comprises an electric motor having a drive shaft having a geared surface and a circular piece having a geared edge, the geared surface of said drive shaft engaging the geared edge of said circular piece.

6. The gimbal structure of claim 1 and further including roller means abutting against the outer surface of said hoop structure and spring means for urging said roller means against said hoop structure.

7. In an antenna system having a support structure, a gimbal system for supporting a circular antenna dish of said antenna system and enabling the orientation of said dish in azimuth and elevation, comprising a hoop structure having a curvature and a central axis which is substantially the same as that of said dish, opposite edge portions of said dish being pivotally supported in an opposing relationship on said hoop, means for driving said hoop structure and said antenna dish along with said hoop structure between a first position whereat the Y-axis of said antenna dish is at a predetermined "zero" position to a second position whereat said Y axis is between said zero position and ninety degrees from said zero position, and means mounted on said hoop structure adjacent to one of said pivotally supported dish edge positions of said dish for driving said dish about its pivotal support axis, said antenna dish being driven in elevation when the dish Y axis is in its "zero" position and in azimuth or a combination of azimuth and elevation when said Y axis is between the "zero" position and ninety degrees from said zero position.

8. The system of claim 7 wherein the hoop structure is formed in two opposing sections with a space therebetween.

9. The system of claim 7 where said hoop structure is semi-circular.

10. The system of claim 7 wherein the means for driving said hoop structure comprises an electric motor having a drive shaft with a geared drive surface, said hoop structure having a geared surface which engages said geared drive surface.

11. The system of claim 7 wherein said means for driving said antenna comprises an electric motor having a drive shaft with a geared surface and a circular member attached to the edge of said dish which said drive shaft engages.

12. The system of claim 7 and further including roller means in abutment against said hoop structure, and spring means supported on the antenna support structure for urging said roller means towards said hoop structure.

13. A method for orienting the circular dish of an antenna in azimuth and elevation comprising the steps of:

pivotally attaching the ends of a hoop structure having the same curvature and the same central axis as said dish to the rim of said dish with the center of the hoop positioned along the Y axis of said dish, driving one of the ends of said dish pivotally about its "X" axis to orient the dish in elevation, driving the hoop structure about its central axis to carry the antenna dish so that its Y axis is positioned between its initial position and ninety degrees from its initial position, and driving said one end of said dish pivotally about the "X" axis of the dish to orient the dish in azimuth or a combination of azimuth and elevation.

14. The method of claim 13 wherein said hoop structure is in the form of a semi-circle.

* * * * *